US010008185B2

(12) United States Patent
Rulifson

(10) Patent No.: US 10,008,185 B2
(45) Date of Patent: Jun. 26, 2018

(54) STRINGED INSTRUMENT WITH LEAD CRYSTAL FINGERBOARD OR FRETBOARD AND BRIDGE

(71) Applicant: Alan Rulifson, St. Petersburg, FL (US)

(72) Inventor: Alan Rulifson, St. Petersburg, FL (US)

( * ) Notice: Subject to any disclaimer, the term of this patent is extended or adjusted under 35 U.S.C. 154(b) by 0 days. days.

(21) Appl. No.: 15/655,745

(22) Filed: Jul. 20, 2017

(65) Prior Publication Data

US 2018/0033408 A1 Feb. 1, 2018

Related U.S. Application Data

(60) Provisional application No. 62/366,993, filed on Jul. 26, 2016.

(51) Int. Cl.

| | |
|---|---|
| ***G10D 1/00*** | (2006.01) |
| ***G10D 3/04*** | (2006.01) |
| ***G10D 3/06*** | (2006.01) |
| ***G10D 3/12*** | (2006.01) |

(52) U.S. Cl.

CPC ..... *G10D 1/005* (2013.01); *G10D 3/04* (2013.01); *G10D 3/06* (2013.01); *G10D 3/12* (2013.01)

(58) Field of Classification Search

CPC ..... G10D 1/005; G10D 3/04

See application file for complete search history.

(56) References Cited

U.S. PATENT DOCUMENTS

| | | | | |
|---|---|---|---|---|
| 4,944,209 | A * | 7/1990 | Fishman | G10H 3/185 84/731 |
| 7,368,646 | B2 * | 5/2008 | Payung | G10D 1/005 84/290 |
| 7,767,890 | B2 * | 8/2010 | Stein | G10D 1/005 84/267 |
| 8,039,720 | B2 * | 10/2011 | Stein | G10D 1/005 84/267 |
| 2004/0040432 | A1 * | 3/2004 | Erickson | G10D 3/04 84/306 |
| 2004/0129127 | A1 * | 7/2004 | Mercer | G10D 3/02 84/307 |
| 2005/0252357 | A1 * | 11/2005 | Albert | G10D 1/005 84/294 |
| 2018/0033408 | A1 * | 2/2018 | Rulifson | G10D 1/005 |

* cited by examiner

*Primary Examiner* — Robert W Horn
(74) *Attorney, Agent, or Firm* — Justin Luby

(57) ABSTRACT

The fingerboard/fretboard and/or bridge of a stringed instrument such as a guitar or violin is constructed lead crystal in lieu of the tradition wood construction utilized for these components. The lead crystal components are identically shaped to the components they are replacing. Changing the materials of construction of the fingerboard/fretboard and/or bridge to lead crystal in the stringed instrument creates a sound which is cleaner and with less distortion than those stringed instrument with a wooden fingerboard/fretboard and/or bridge. Additionally, utilizing a lead crystal the fingerboard/fretboard and/or bridge also provides a unanticipated benefit, the instrument is no longer capable of creating a screeching sound when played improperly. The resulting instrument is one which is simpler to play for both novices and advanced players, which is still capable of emanating an appealing sound.

12 Claims, 7 Drawing Sheets

STRINGED INSTRUMENT WITH LEAD CRYSTAL FINGERBOARD OR FRETBOARD AND BRIDGE

CROSS-REFERENCE TO RELATED APPLICATIONS

This application claims priority to provisional application U.S. Ser. No. 62/366,993 filed Jul. 26, 2016. Said application is incorporated by reference herein in its entirety.

FIELD OF THE INVENTION

The present invention relates generally to stringed instruments and more specifically the fingerboards/fretboards and bridges utilized for these instruments.

BACKGROUND

Violins, guitars, pianos, and other stringed instruments are typically constructed of traditional materials, most generally wood for the fingerboard/fretboard and/or bridge. Musical purists frown upon the construction of these instruments from atypical materials, as the resulting sound is inferior to those instruments constructed of the traditional materials.

While violins, guitars, and other stringed instruments, where the fingerboard/fretboard and/or bridge is constructed of traditional materials, may produce the most appealing resulting sounds to musical purists, leading to play these instruments well is a time consuming and potentially frustrating journey for many aspiring musicians.

Specifically, while learning to play the guitar or the violin, beginners will tend to generate high pitched screeching sounds by improperly moving their fingers or bows across the strings. This screeching sound is typically unpleasant and can discourage beginners.

Accordingly, there is a need for a stringed instrument that is constructed of materials which significantly reduce or eliminate altogether the screeching noises and other distortions that can occur due to improper fingering or bowing of a stringed instrument.

Additionally, the resulting sound which emanates from the stringed instrument that reduces or eliminates screeching noises and other distortions and must emanate similarly clean sound while substantially resembling an instrument constructed of typical materials of construction.

SUMMARY

To accomplish these objects, the fingerboard/fretboard and/or bridge of a stringed instrument is constructed lead crystal in lieu of the tradition wood construction utilized for these components. The lead crystal components are identically shaped to the components they are replacing.

Changing the materials of construction of the fingerboard/fretboard and/or bridge to lead crystal in the stringed instrument creates a sound which is cleaner and with less distortion than those stringed instrument with a wooden fingerboard/fretboard and/or bridge.

Utilizing a lead crystal the fingerboard/fretboard and/or bridge also provides a unanticipated benefit, the instrument is no longer capable of creating a screeching sound when played improperly.

The resulting instrument is one which is simpler to play for both novices and advanced players, which is still capable of emanating an appealing sound.

DETAILED DESCRIPTION OF THE INVENTION AND PREFERRED EMBODIMENT

Figure 1:
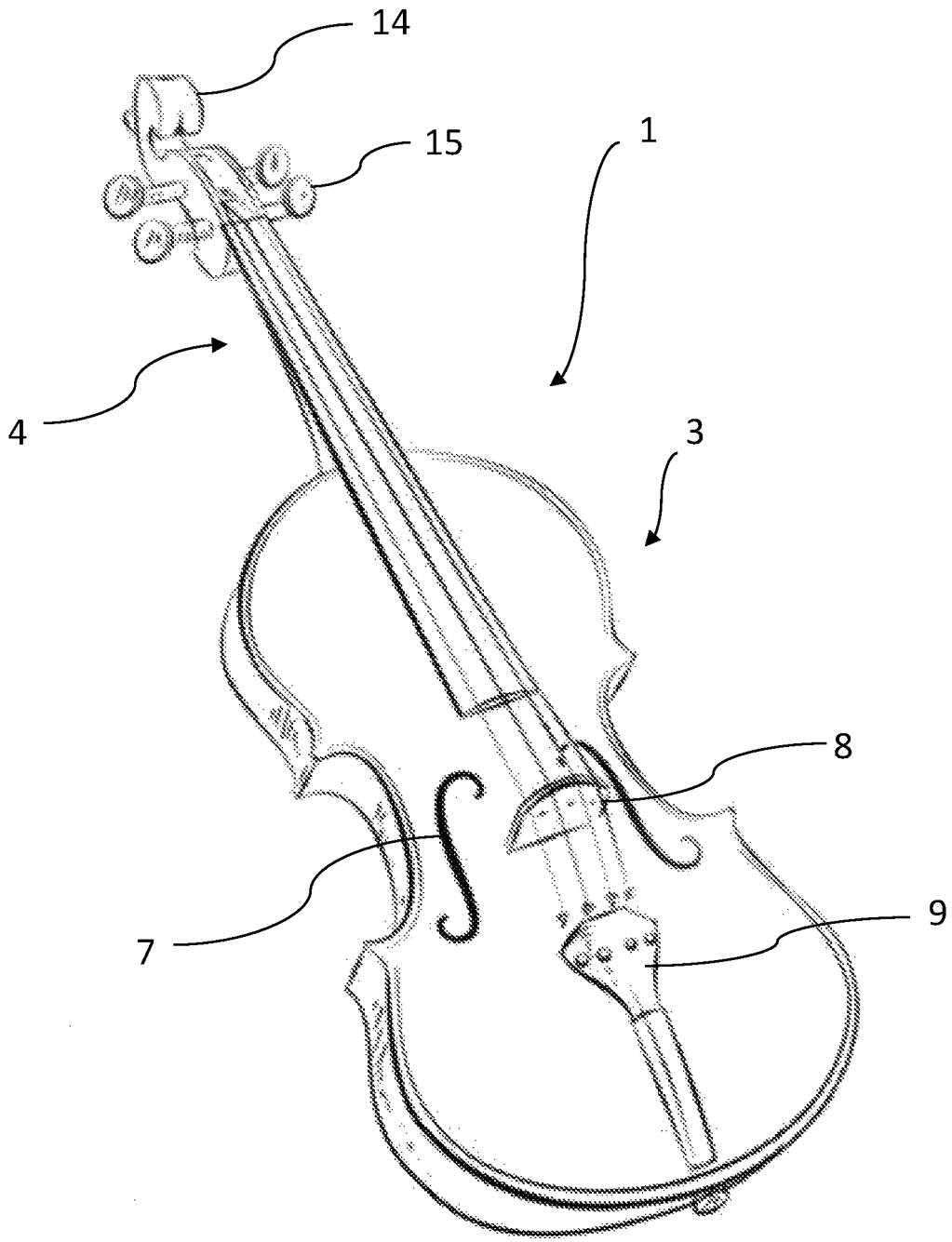
FIG. 1 illustrates a perspective view of the violin embodiment of the current invention.
Figure 2:
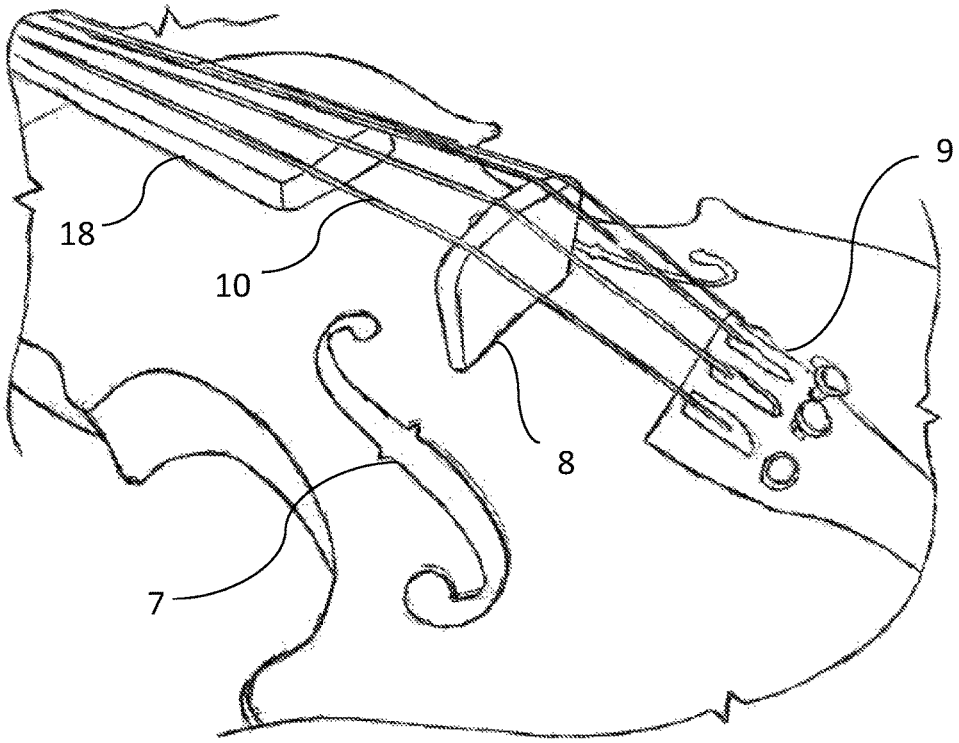
FIG. 2 illustrates a perspective view of the bridge area of the violin embodiment of the current invention.
Figure 3:
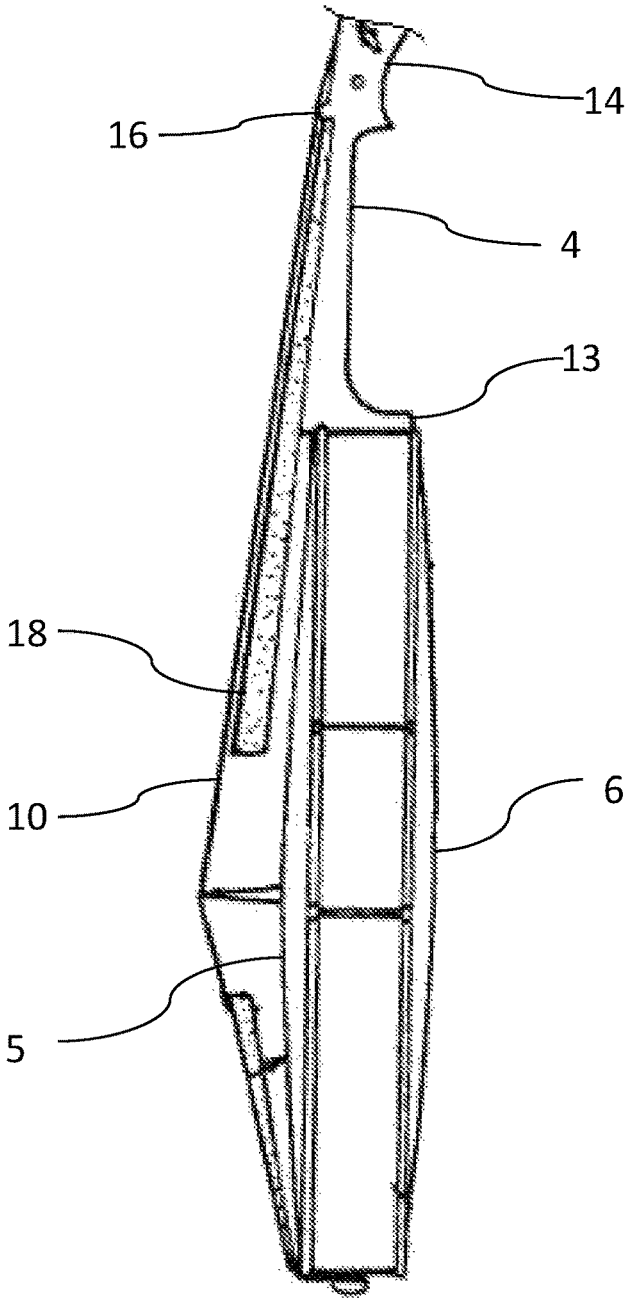
FIG. 3 illustrates a side view of the violin embodiment of the current invention.
Figure 4:
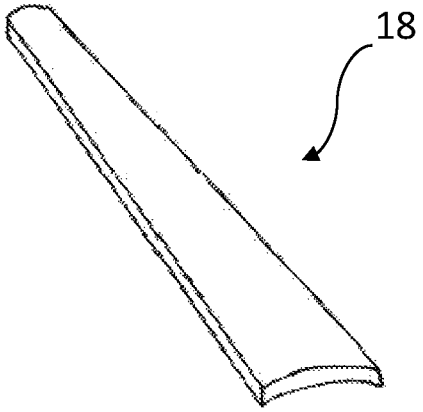
FIG. 4 illustrates a perspective view of the fingerboard of the current invention.
Figure 5:
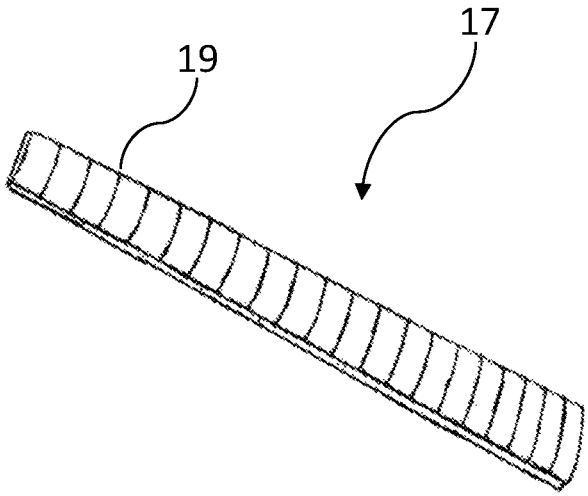
FIG. 5 illustrates perspective view drawing of a fretboard of the current invention.
Figure 6:
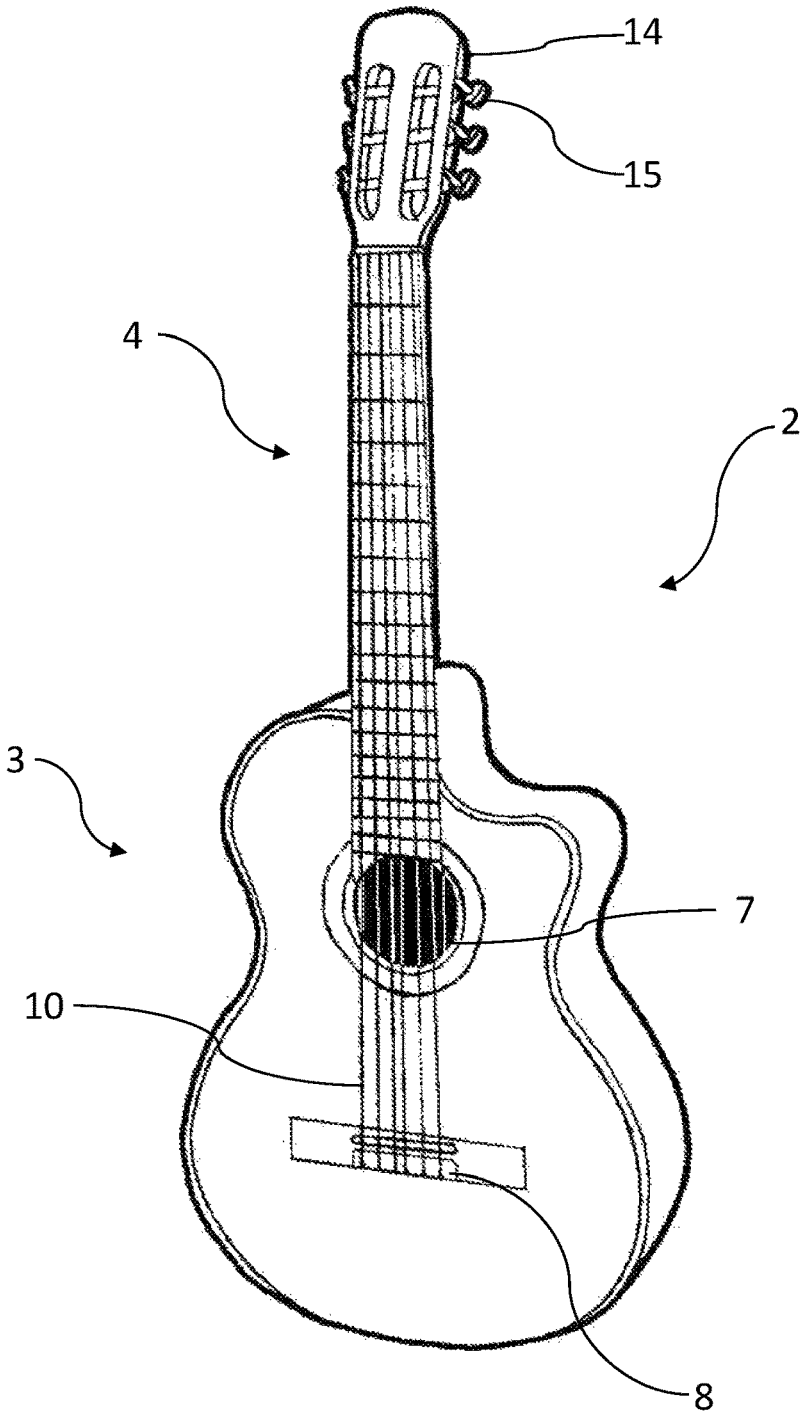
FIG. 6 illustrates a perspective view of the guitar embodiment of the current invention.
Figure 7:
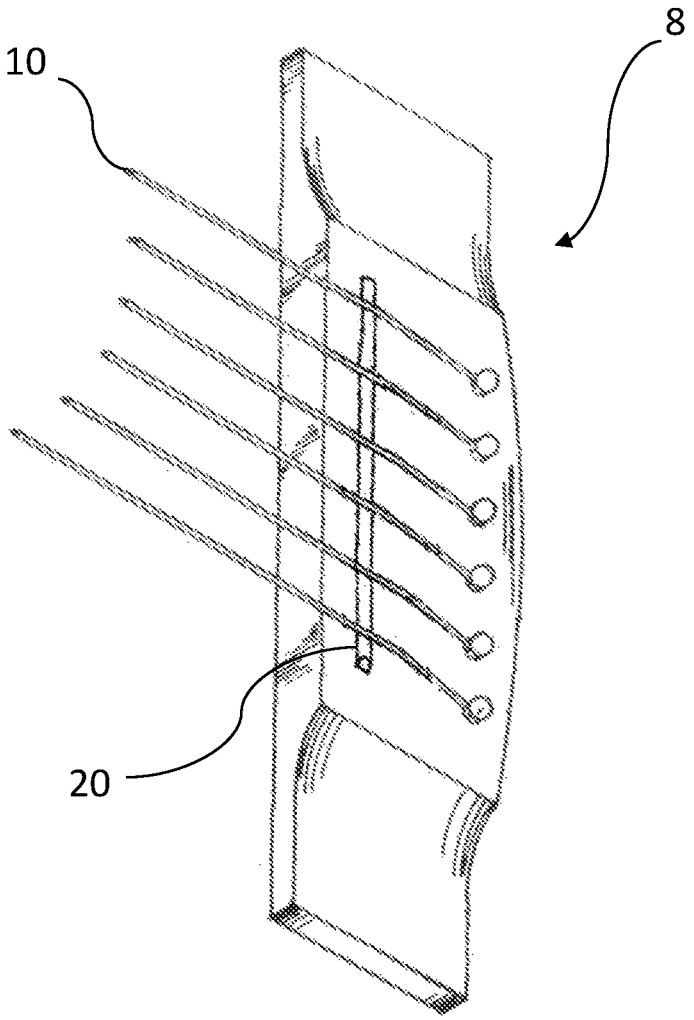
FIG. 7 illustrates a perspective view of the bridge area of the guitar embodiment of the current invention.

Referring to FIGS. 1 & 4, acoustical violins 1 and guitars 2 are stringed musical instruments which generally include a hollow body 3 connected to a neck 4. The body 3 includes a soundboard 5 and backboard 6, with the soundboard 5 typically including at least one sound hole 7. The body further includes a bridge 8 and tailpiece 9 located near the end of the violin 1 or guitar 3 opposite the neck 4 which serve to anchor one end of the strings 10.

Most stringed instruments produce their sound through the application of energy to the strings 10, which sets them into vibratory motion. The strings 10 alone, however, produce only a faint sound because they displace only a small volume of air as they vibrate. Consequently, the sound of the strings alone requires impedance matching to the surrounding air by transmitting their vibrations to a larger surface area capable of displacing larger volumes of air (and thus producing louder sounds). This calls for an arrangement that allows for the strings to vibrate freely, but also conducts those vibrations efficiently to the soundboard 5. A bridge 8 is the customary means by which this is accomplished.

The bridge 8 must transfer vibration to the soundboard 5. As the strings 10 are set in motion, it does this by bending to and fro along the string direction at twice the rate of the string vibration. This causes the soundboard 5 to vibrate at the same frequency as the string 10 producing a wave-like motion and an audible sound.

Bridges 8 are designed to hold the strings at a suitable height above the fingerboard 18 or fretboard 17 of the instrument. The ideal bridge 8 height creates sufficient angularity in the string 10 to create enough down force to drive the top, but places the strings 10 sufficiently close to the fingerboard 18 or fretboard 17 to make noting the strings easy.

In addition to supporting the strings 10 and transmitting their vibrations, the bridge 8 can also controls the spacing between strings 10 with shallow grooves (not pictured) cut in the bridge 8. The strings sit in those grooves, thus are held in their proper lateral position.

Bridges 8 may consist of a single piece of material, most commonly wood, that fits between the strings and the resonant surface. Alternatively, a bridge 8 may consist of multiple parts. One common form is a bridge that incorporates a separate bearing surface on which the strings rest, termed a saddle 20. This is often of a material harder than the bridge itself, such as bone, ivory, high-density plastic, or metal.

The body of a guitar 2 or violin 1 is connected to the neck 4 of the instrument using a heelblock 13. The neck 4 includes a headstock 14 at the end of the neck opposite the body 3. The headstock 14 includes tuning keys 15 to adjust and maintain the tension of the strings 10. The neck 4 also includes the nut 16, a small strip of medium-hard material that supports the strings 10 at the periphery of the headstock 14.

The neck also includes a fretboard 17 or fingerboard 18 disposed between the body 3 and the nut 16. A fingerboard 18 spans the entire width of the neck 4 and is mounted above a flat surface of the neck 4 oriented towards the strings 10. A fingerboard 18 is a smooth surface and will not have any frets on its surface. Additionally, a fingerboard 18 may extend beyond the neck 4 of the instrument. The fingerboard 18 provides a surface upon which a person playing the instrument presses down the strings 10 to adjust the effective length of the strings 10.

Many stringed instruments, utilize a fingerboard 18 which includes frets 19 which permit the instrument to play a discrete scale of notes as determined by the spacing of the frets 19 and the composition and tension of the strings 10. Frets 19 are raised strips of hard material perpendicular to the strings 10, which the player presses the strings against to stop the strings 10. A fingerboard 18 with frets 19, is also known as a fretboard 17. The fretboard 17 must remain close to but not contact the unpressed strings 10 along the entire length of the fretboard 17. The fretboard 17 must not create any buzz, rattle, distortion or other undesirable vibrations.

Fretboards 17 are more commonly utilized with guitars 2 and fingerboards 18 are more commonly utilized with violins 1.

Lead crystal or lead glass is a variety of glass in which lead replaces the calcium content of a typical potash glass. Lead crystal contains typically 18-40 weight % lead oxide (PbO). Lead crystal is known for its clarity of sound when compared to other glasses. The clarity is demonstrated by the long, pure ring when a crystal glass is struck. Low-quality glass will often ring with a brief, dull tone. The greater the lead contents of the crystal, ranging from 18-40%, the greater the sound quality which emanates.

Lead crystal vibrates at a consistent wavelength, therefore, any vibration applied to the surface of a lead crystal component will also have a consistent wavelength. When a string 10 vibrates, distortion/harmonics can be affected by whatever the string 10 is in contact, which in a stringed instrument will be the bridge 8, nut 16, fretboard 17, and/or fingerboard 18. The use of lead crystal in the construction of the bridge 8, nut 16, fretboard 17, and/or fingerboard 18 will remove most of the distortion/harmonics regardless of the note which is played.

When the bridge 8, nut 16, fretboard 17, and/or fingerboard 18 for the stringed instrument are manufactured from lead crystal, the sound which will emanate from the instrument when played sounds cleaner, with less distortion than an identical instrument manufactured with a wooden bridge 8, nut 16, fretboard 17, and/or fingerboard 18.

In addition to the improved sound quality, there is an unexpected benefit to replacing the bridge 8, nut 16, fretboard 17, and/or fingerboard 18 with lead crystal components, the instrument will no longer create the annoying high pitched screeching sounds which can occur when the player misplays the instrument.

While not as prevalent with a guitar 2, a novice violin 1 player will oftentimes create these loud screeching noises by pressing too hard on the strings 10 with the bow or drawing the bow across the strings 10 at the incorrect angle. These screeching mistakes will disturb both the player and those in earshot, and could lead to an embarrassing moment during a public demonstration, such as a recital.

In the preferred embodiment, the lead bridge 8, nut 16, fretboard 17, and/or fingerboard 18 are manufactured utilizing a kiln casting process. Kiln casting requires the creation of a heat resistant mold which contains a hollow cavity of the desired shape of the bridge 8, nut 16, fretboard 17, and/or fingerboard 18. The heat resistant mold is then placed in a kiln with a funnel like opening which is filled with solid glass granules or lumps. The kiln is heated to a between 800 and 1000 degrees Celsius (1472-1832 F), and as the glass melts it runs into and fills the mold. Once the glass has melted and filled the mold, the mold can be removed from the kiln and allowed to cool.

While the manufacturing process in the preferred embodiment is kiln casting, the manufacturing process used to create the bridge 8, nut 16, fretboard 17, and/or fingerboard 18 is not critical to the resulting product and could be manufactured utilizing any methods available.

In an alternate embodiment of the invention, instead of the bridge 8, nut 16, fretboard 17, and/or fingerboard 18 being manufactured from cast lead crystal, the bridge 8, nut 16, fretboard 17, and/or fingerboard 18 will instead have a lead crystal enamel coating on the components. The lead crystal enamel coating will produce the same desired effect of creating a sound which is cleaner and with less distortion and eliminating the screeching sound which can be created through improper play.

In an another alternate embodiment of the invention, instead of the entire bridge 8, nut 16, fretboard 17, and/or fingerboard 18 being manufactured from cast lead crystal, only those components which are in direct contact with the strings 10 are constructed of lead crystal, such as the nut 16, the frets 19, and the saddle 20. In this embodiment of the invention, the remainder of the bridge 8, fretboard 17, and/or fingerboard 18 are constructed of traditional materials.

Once the lead crystal bridge 8, nut 16, fretboard 17, and/or fingerboard 18 have been manufactured they can be affixed to the sounding board and neck of the instrument. In the preferred embodiment the lead crystal bridge 8, nut 16, fretboard 17, and/or fingerboard 18 are attached to the soundboard 3 and neck 4 of the instrument utilizing adhesive, however, the lead crystal bridge 8, nut 16, fretboard 17, and/or fingerboard 18 could be affixed to the soundboard 3 and neck 4 utilizing any method known to those skilled in the art.

While the above description specifically deals with guitars 2 and violins 1, this description would provide one skilled in the art with the capability to manufacture nearly any stringed instrument with a bridge 8, nut 16, fretboard 17, and/or fingerboard 18 to achieve the same desired effect.

Figure 8:
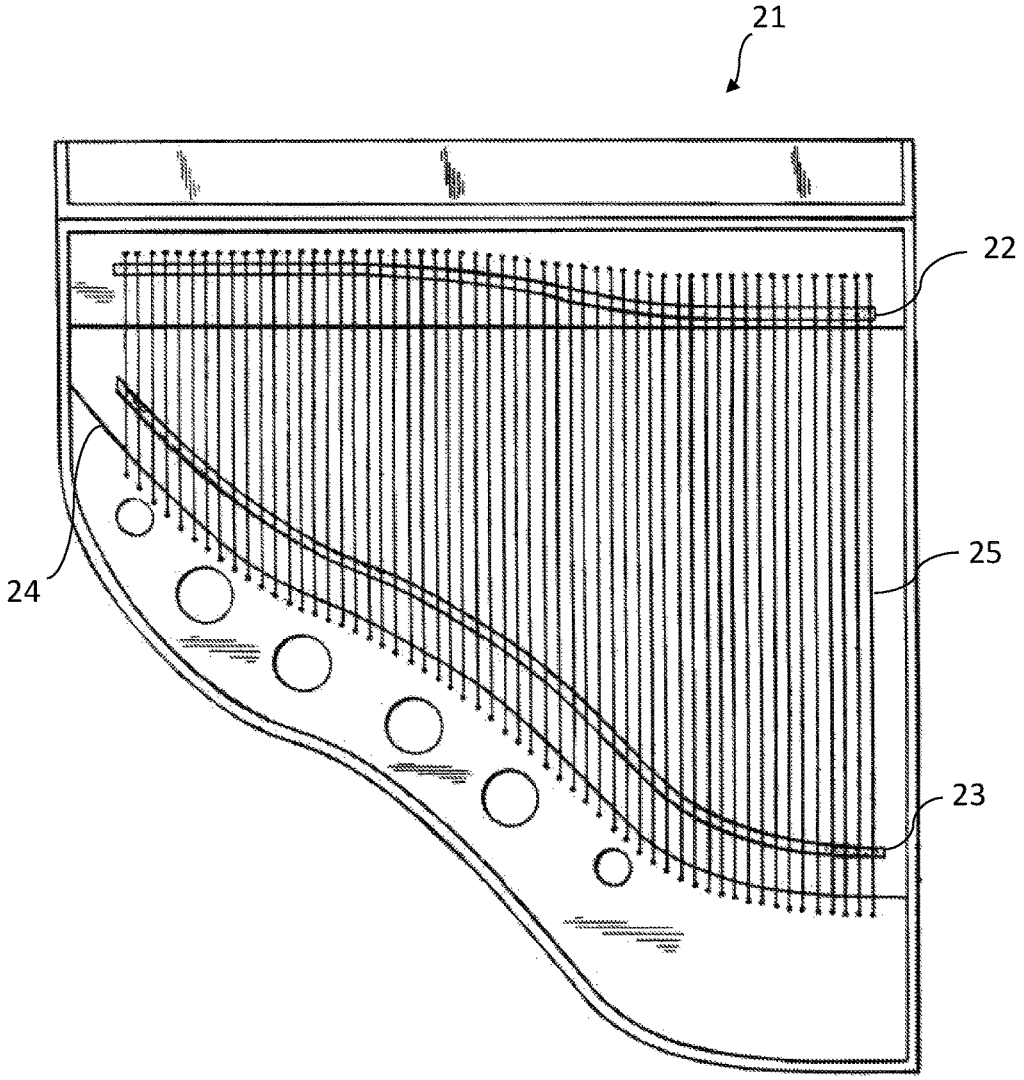
FIG. 8 illustrates a top view detailing the soundboard area of the piano embodiment of the current invention.

Additionally, referring to FIG. 8, the use of lead crystal bridges 8 could also be applied to pianos 21 and other similar instruments, where nut 16, fretboard 17, and/or fingerboard 18 are not utilized, however, strings 10 are suspended between two bridges 22 & 23. The bridges 22 & 23 play a crucial role in the sound of the piano 20. It is the job of the bridges 22 & 23 to connect the the strings 25 to the amplifier of the sound, the soundboard 24. There are two bridges 22 & 23 attached to the top of the soundboard 24. The treble and tenor strings pass over the long bridge 23, and the bass strings pass over the short bridge 22. Replacing the two 22 & 23 with lead crystal 22 & 23 manufactured using the methods described above, will similarly produce a distinct sound that listeners may find more pleasing.

It would be appreciated by those skilled in the art that various changes and modifications can be made to the illustrated embodiments without departing from the spirit of the present invention. All such modifications and changes are intended to be covered by the appended claims.

What is claimed is:

1. A stringed instrument which comprises;

(a) a body having a top surface;

(b) a neck extending from the body;

(c) a headstock extending from the neck;

(d) a plurality of strings having a vibration length extending along the body and the neck in a longitudinal direction;

(e) a fingerboard extending along the longitudinal direction on the neck; and (f) a bridge fitting between the strings and the top surface of the body;

whereas the surfaces of the fingerboard and bridge which contact the strings of the instrument are constructed of lead crystal.

2. The stringed instrument of claim 1, whereas said fingerboard further comprises a plurality of frets where the surfaces of the frets which contact the strings of the instrument are constructed of lead crystal.

3. The stringed instrument of claim 1, further comprising a nut, whereas the nut supports the strings at the periphery of the headstock and surfaces of the nut which contact the strings of the instrument are constructed of lead crystal.

4. The stringed instrument of claim 2, further comprising a nut, whereas the nut supports the strings at the periphery of the headstock and surfaces of the nut which contact the strings of the instrument are constructed of lead crystal.

5. The stringed instrument of claim 1, whereas said stringed instrument comprises a violin comprising a fingerboard, a nut, and a bridge which are constructed of lead crystal.

6. The stringed instrument of claim 1, whereas said stringed instrument comprises a guitar comprising a fingerboard with a plurality of frets, a nut, and a bridge which are constructed of lead crystal.

7. A stringed instrument which comprises:

(a) two or more abutments that suspend portions of the strings, the spacing of which abutments provides desired primary string vibration frequency or tuning, wherein at least one of the abutments transmits vibrations to a soundboard or sound-amplifying structure;

(b) anchors which hold the strings in place on the abutments and maintain desired string tension; and (c) adjustment means for setting string tension to provide desired base frequency or tuning, the stringed instrument comprising one or more of components (a), (b) and (c) having surfaces which contact the strings of the instrument are constructed of lead crystal.

8. The stringed instrument of claim 7 wherein said component is a bridge, saddle, fret, or nut.

9. The stringed instrument of claim 7 wherein said component is a fingerboard or fretboard.

10. The stringed instrument of claim 7 wherein the musical instrument is a guitar.

11. The stringed instrument of claim 7 wherein the musical instrument is a violin.

12. The stringed instrument of claim 7 wherein the musical instrument is a piano.

* * * * *